United States Patent [19]

Hayashi et al.

[11] Patent Number: 4,728,595

[45] Date of Patent: Mar. 1, 1988

[54] PHOTOGRAPHIC ELEMENT

[75] Inventors: Hiroshi Hayashi; Masaharu Toriuchi; Junichi Yamanouchi; Junichi Matsuyama, all of Kanagawa, Japan

[73] Assignee: Fuji Photo Film Co., Ltd., Kanagawa, Japan

[21] Appl. No.: 813,211

[22] Filed: Dec. 24, 1985

[30] Foreign Application Priority Data

Dec. 26, 1984 [JP] Japan ..... 59-279234
Jan. 17, 1985 [JP] Japan ..... 60-6583

[51] Int. Cl.[4] ..... G03C 5/54; G03C 1/86

[52] U.S. Cl. ..... 430/220; 430/215; 430/227; 430/262; 430/263; 430/950

[58] Field of Search ..... 430/220, 227, 215, 950, 430/262, 263

[56] References Cited

U.S. PATENT DOCUMENTS 3,833,369 9/1974 Chiklis et al. ..... 430/220
4,606,992 8/1986 Bishop ..... 430/220

FOREIGN PATENT DOCUMENTS 0668592 8/1963 Canada ..... 430/220
0066341 12/1982 European Pat. Off. ..... 430/220

OTHER PUBLICATIONS

"Photographic Processes and Products", *Research Disclosure, No. 15162, 11/1976, pp. 75–87.*

*Primary Examiner*—Richard L. Schilling
*Attorney, Agent, or Firm*—Sughrue, Mion, Zinn, Macpeak & Seas

[57] ABSTRACT

A photographic light-sensitive element is described comprising a support having provided thereon at least one of a light-sensitive silver halide emulsion layer and an image-receiving layer, in which a layer comprising a light-reflective organic polymer is provided between the support and the light-sensitive silver halide layer or the image-receiving layer. The light-reflective organic polymer layer serves as a stripping layer without retarding image-formation.

3 Claims, No Drawings

PHOTOGRAPHIC ELEMENT

FIELD OF THE INVENTION

This invention relates to a photographic element, and, more particularly, to a photographic element having improved photographic performance properties.

BACKGROUND OF THE INVENTION

It is well known to incorporate a light-reflective pigment in a photographic element. For example, Japanese Patent Application (OPI) No. 17435/83 (the term "OPI" used herein refers to an "unexamined published application") discloses incorporation of a light-reflective pigment, e.g., titanium oxide, in a layer adjacent to a silver halide emulsion layer (i.e., a backing layer) for the purpose of increasing sensitivity through control of light at the time of exposure. Further, use of pearlescent pigments in place of titanium oxide for the same purpose is disclosed in Japanese Patent Publication Nos. 3406/79, 6172/76, and 49174/74.

Light-reflective pigments have been employed not only for improvement of sensitivity as mentioned above, but also for construction of a light-reflective layer serving as the background of an image (also referred to as a background layer).

Although titanium dioxide, magnesium sulfate, zinc oxide, zirconium oxide, aluminum oxide and zinc carbonate used for these purposes are superior in light reflectivity, they involve problems such as unstable supply because they are mineral resources and impairment of photographic properties, for example, by accelerating light discoloration of image-forming dyes, due to their photochemical activity.

Accordingly, it has been desired to develop a light-reflective material as a substitute for such photochemically active light-reflective pigments, viz., a photochemically inactive material which is not inferior to titanium oxide.

Further, when the conventionally employed titanium oxide is mixed with a binder, such as gelatin and polyvinyl alcohol, flocculation frequently occurs unless high energy is applied by a dispersing machine, etc., which gives rise to great difficulty in production control. Development of a light-reflective material in place of titanium dioxide is significant also from this point of view.

In monosheet type photographic light-sensitive elements, titanium dioxide, etc., are inexpensive and also excellent in light reflectivity as light-reflective pigments. However, they must be used in a large quantity for forming a background of a transferred image, thus necessarily resulting in large film thickness. As a result, it takes time for the image-forming materials to penetrate through a white reflective layer, thereby retarding image formation. In this sense, it has been desired to make a white reflective layer as thin as possible.

From the viewpoint of filing photographic prints typically inserted into albums, monosheet type photographic light-sensitive elements are inconvenient due to their thickness. A method for eliminating this inconvenience is disclosed in Japanese Patent Application (OPI) Nos. 67840/81 and 220727/84, etc. According to this method, after a monosheet photographic light-sensitive material is exposed to light and developmentprocessed, an image-receiving element including a white reflective layer (i.e., photographic print) is stripped from a light-sensitive element to thereby make the photographic print thinner.

However, a light-sensitive element of this type, as disclosed in Japanese Patent Application No. 220727/84, requires two additional hydrophilic polymer layers in order to facilitate stripping, leading to a great increase of film thickness, thus involving a serious problem such that transfer of image-forming materials to an image-receiving layer, i.e., image-formation is retarded.

It has been described to use a hydrophobic compound, such as straight chain alkyl group perfluoroalkylate sulfonamide esters, polyethylene oxide perfluoroalkylate sulfonamide esters, etc., as the aforesaid stripping layer instead of the hydrophilic polymer, as disclosed in U.S. Pat. No. 4,459,346. This method, however, similarly requires an extra layer which functions only for stripping, and which, therefore, has many disadvantages, such as increasing costs and necessitating equipment for coating such a layer.

Hence, the present inventors have conducted investigations in an attempt to develop a photochemically inactive light-reflective material as a substitute for photochemically active light-reflective pigments, such as titanium dioxide, and further to develop a light-reflective material providing a white reflective layer (background layer) which also serves as a stripping layer.

SUMMARY OF THE INVENTION

Accordingly, an object of this invention is to provide a photographic element having a layer comprising a photochemically inactive light-reflective material.

Another object of this invention is to provide an energy-saving type photographic element having a light-reflective material which can be produced without requiring high energy.

A further object of this invention is to provide a monosheet type diffusion transfer photographic light-sensitive element in which a transfer-processed image part can be completely stripped off with a good appearance on the stripped surface.

A still further object of this invention is to provide a photographic light-sensitive element having a white reflective layer which also serves as a stripping layer.

A yet further object of this invention is to provide a photographic light-sensitive element having a stripping layer which does not cause retardation of image formation.

As a result of extensive studies, it has now been found that the above-described objects can effectively be achieved by a photographic element comprising a support having provided thereon at least one of a light-sensitive silver halide emulsion layer and an image-receiving layer, wherein a layer comprising a light-reflective organic polymer is provided between the support and the light-sensitive silver halide emulsion layer or the image-receiving layer.

It has also been found that the above objects can effectively be accomplished by a monosheet type photographic light-sensitive element comprising a support having provided thereon at least an image-receiving layer, a white reflective layer and a silver halide photographic emulsion layer, in the order listed, wherein the white reflective layer is composed of at least two layers, one layer of which contains a larger amount of a light-reflective organic polymer than the layer(s), and the other layer(s) of said white reflective layers contain(s) a larger amount of a light-reflective pigment than said layer containing a larger amount of a light-reflective organic polymer.

DETAILED DESCRIPTION OF THE INVENTION

"Light reflectivity" of a layer comprising a light-reflective organic polymer which can be used in the present invention can be quantitatively determined as follows. An organic polymer is coated on a 100 μm thick transparent polyethylene terephthalate support to a coverage of 3 g/m$^2$, and black paper having a reflectance of less than 5% to the visible region having a wavelength of from 340 to 700 nm is superposed thereon. Light is irradiated from one side of the support, and the quantity of light reflected by the organic polymer layer is determined using the conventional spectrophotometer. The terminology "a layer comprising a light-reflective organic polymer" refers to a layer having a light reflectance as defined above of at least 30% for light of 440 nm and at least 20% for light of 640 nm, and is not deemed to limit the purpose of use.

The layer comprising a light-reflective organic polymer is made opaque essentially by light diffusion at the interface between the organic polymer and a gas (e.g., air) or a liquid (e.g., water) or other organic polymer present in the same layer making use of a difference in light reflectance between them. To the contrary, the conventional light-reflective layer comprising a polymer binder, e.g., gelatin, and a mineral material having a high reflectance, e.g., titanium dioxide, is made opaque essentially by the high reflectance of the mineral material per se. Even in cases in which air is included in the titanium dioxide-containing layer by subjecting titanium dioxide to surface treatment, converting titanium dioxide to a special form, or the like, opacity of the reflective layer is predominantly achieved by the high reflectance of titanium dioxide, with the difference in reflectance between titanium dioxide and air in the same layer being utilized only incidentally. A difference in reflectance between gelatin and air in the same layer is not, therefore, utilized. Thus, such a layer does not fall within the category of a "layer comprising a light-reflective organic polymer" as referred to in the present invention.

The layer comprising a light-reflective organic polymer belonging to the category according to the present invention includes a polymer layer (membrane) having light-reflectivity due to air voids incorporated therein during the preparation thereof. In such a polymer layer, diffusion of light occurs in the interface between the polymer membrane and voids essentially due to difference in refractive index between the polymer (refractive index: ca. 1.5) and air in the membrane (refractive index: 1.0) to thereby make the layer opaque.

The above-described light-reflective organic polymer layer can be formed by coating a homopolymer, e.g., polyethylene, polystyrene, polyhydroxyethyl methacrylate, polyvinylpyrrolidone, polyvinyl alcohol, hydroxyethyl cellulose, etc.; a copolymer of a monomer constituting these homopolymers and other vinyl monomers; gelatin; or a gelatin derivative using a poor solvent, such as a ketone, e.g., acetone, methyl ethyl ketone, etc.; an alcohol, e.g., methanol, ethanol, diacetone alcohol, etc.; water; and a mixture thereof.

The other vinyl monomer as referred above includes addition-polymerizable ethylenically unsaturated compounds, e.g., styrenes, acrylic acid, methacrylic acid or esters or amides thereof, allyl compounds, vinyl ethers, vinyl esters, vinyl ketones, vinyl heterocyclic compounds, maleic esters, fumaric esters, itaconic esters, sorbic esters, crotonic esters, crotonamides, unsaturated nitriles, olefins, etc.

The layer comprising a light-reflective organic polymer may also be formed by coating a polymer latex.

Methods for obtaining a light-reflective organic polymer layer from polymer latices are described, e.g., in Netherlandish Patent Publication No. 7,604,396, Belgian Pat. No. 841,036, U.S. Pat. No. 3,951,899, *Lakokras Mater Ikh Primen.*, Vol. 4, pp. 7–8 (1975), West German Patent Publication (OLS) No. 2,412,066, *Journal of Colloid and Interface Science*, Vol. 76 (1), pp. 182–187 (1980), etc.

Methods for forming a light-reflective organic polymer layer having microcells or fine pores from polymer latices are described, e.g., in U.S. Pat. No. 3,817,880, West German Patent Publication (OLS) No. 2,063,949, etc.

The layer comprising a light-reflective organic polymer is preferably formed from a light-reflective core/shell type polymer latex. A polymer latex of this type comprises a hard solid core and a soft solid shell as disclosed, e.g., in Belgian Pat. No. 894,299. A preferred weight ratio of the shell to the whole of the core and shell structure is from 0.25/1 to 0.5/1. Another example of the core/shell type polymer latex is described in U.S. Pat. No. 3,582,512. This polymer latex is a copolymer comprising at least one of a monovinylidene aromatic hydrocarbon (Monomer A), α,β-ethylenically unsaturated carboxylic acid (Monomer B), and a mutually non-conjugated olefinic compound (Monomer C), in which the copolymerization proportion is varied between the core and the shell. For example, the polymer latex in the core comprises from 65 to 100 mol% of Monomer A, up to 3 mol% of Monomer B and the remainder of Monomer C, and the shell comprises from 24 to 70 mol% of Monomer B, from 0.6 to 3 mol% of Monomer C, and the remainder of Monomer A. A preferred weight proportion of the core to the whole of the core and shell structure is from 60 to 90%.

Among various types of layers comprising a light-reflective organic polymer which can be used in the present invention, the most preferred is a layer comprising a latex of a light-reflective hollow polymer containing air in the interior thereof. Such a hollow polymer latex can be synthesized by various processes. One of general processes comprises preparing a core/shell type polymer latex wherein water as a core is coated with a polymer membrane by an emulsion polymerization process or the like and replacing the inside water with air by evaporation in the course of film formation on a support. Specific examples of this process are described, e.g., in U.S. Pat. Nos. 2,339,707, 2,739,909, 2,961,339, 3,157,533, 3,328,184, 3,372,044, 3,478,716, 3,766,102, and 3,896,138, and in British Pat. Nos. 962,702 and 967,223. The hollow polymer latex may also be prepared by a solvent precipitation process which comprises dissolving a polymer in a volatile good solvent, adding a nonvolatile non-solvent thereto, forming a film from the resulting mixture, and drying the coated film to thereby precipitate a swollen polymer and to produce a discontinuous polymer membrane containing air bubbles therein. Additional specific examples of hollow polymer latices applicable as a film-forming material are described in *Aust. OCCA Proc. News*, No. 11, pp. 4–9 and 12–13 (1982), *Resin Review*, Vol. 33 (No. 2), pp. 3–8

(1983) and *Journal of Paint Technology*, Vol. 43 (No. 563), pp. 50–60 (1971).

Light-reflectivity of the hollow polymer is attributed to a difference in reflectance between a polymer and air as mentioned above. In the aforesaid particular polymer latices, air is contained inside the spherical polymer particles so that a difference in reflectance between the inside air and the surrounding polymer brings about opacity.

Supposing that the hollow polymer that is preferred in the present invention is nearly spherical, an average particle size thereof is from about 0.1 to about 0.8 μm, with the hollow portion thereof having a diameter of from about 0.03 to about 0.7 μm, and the thickness of the polymer membrane is from about 0.05 to about 0.7 μm.

Examples of the above-described core/shell type polymer or hollow polymer latices typically include latices of the aforesaid homopolymer or copolymer of an addition-polymerizable ethylenically unsaturated compound. Specific examples of the addition-polymerizable ethylenically unsaturated compound are acrylic acid; methacrylic acid; an acrylic ester, such as a substituted or unsubstituted alkyl or aryl ester, e.g., methyl acrylate, ethyl acrylate, isopropyl acrylate, n-butyl acrylate, octyl acrylate, 2-chloroethyl acrylate, 2-cyanoethyl acrylate, N-(β-dimethylaminoethyl)acrylate, benzyl acrylate, cyclohexyl acrylate, phenyl acrylate, etc.; a methacrylic esters, such as a substituted or unsubstituted alkyl or aryl ester, e.g., methyl methacrylate, n-propyl methacrylate, isopropyl methacrylate, n-butyl methacrylate, cyclohexyl methacrylate, 3-sulfopropyl methacrylate, etc.; an allyl compound, e.g., allylbutyl ether, allylphenyl ether, etc.; a vinyl ether, e.g., methyl vinyl ether, butyl vinyl ether, methoxyethyl vinyl ether, 2-hydroxyethyl vinyl ether, (2-dimethylaminoethyl) vinyl ether, vinyl phenyl ether, vinyl chlorophenyl ether, etc.; an acrylamide, e.g., acrylamide, N-methylacrylamide, N-(1,1-dimethyl-3-oxobutyl)acrylamide, N-(1,1-dimethyl-3-hydroxybutyl)-acrylamide, N,N-dimethylacrylamide, acryloylhydrazine, N-hydroxymethylacrylamide, etc.; a methacrylamide, e.g., methacrylamide, N-methoxymethylmethacrylamide, N-(1,1-dimethyl-3-hydroxybutyl)methacrylamide, etc.; a vinyl heterocyclic compound, e.g., vinylpyridine, N-vinylimidazole, N-vinylcarbazole, vinylthiophene, etc.; a styrene derivative, e.g., styrene, chloromethylstyrene, p-acetoxystyrene, p-methylstyrene, etc.; a vinyl ester, e.g., methyl p-vinylbenzoate, etc.; a vinylketone, e.g., methyl vinylketone, phenyl vinylketone, etc.; a crotonic ester, e.g., butyl crotonate, glycerin monocrotonate, etc.; an itaconic ester, e.g., methyl itaconate, ethyl itaconate, diethyl itaconate, etc.; a maleic ester, e.g., ethyl maleate, butyl maleate, dibutyl maleate, octyl maleate, etc.; a fumaric ester, e.g., ethyl fumarate, dibutyl fumarate, octyl fumarate, etc.; an unsaturated nitrile, e.g., acrylonitrile, methacrylonitrile, etc.; an olefin inclusive of halogenated olefin, e.g., ethylene, propylene, 1-butene, dicyclopentadiene, 4-methyl-1-hexene, 4,4-dimethyl-1-pentene, vinyl chloride, vinylidene chloride, isoprene, etc.; and the like.

The molar ratio of comonomers for preparing the copolymer latex is not particularly limited and may adequately be selected.

A hollow polymer latex obtained from a copolymer of styrene and acrylic acid or its derivative is commercially available under a trademark "OP-42" from Rohm & Haas Co.

A hollow polymer latex having no film-forming property per se is preferred. In this case, the film-forming property is determined by observing as to whether the latex forms a film through a certain drying temperature. Such a latex can be coated by mixing with an optional proportion of gelatin, a gelatin derivative, or any other binders known in the photographic art, such as polyvinyl alcohol, hydroxyethyl cellulose, carboxymethyl cellulose, polyvinylpyrrolidone, etc.

Since the hollow polymer latex can be coated as dissolved or dispersed in an aqueous medium, such is advantageous in the production process. Further, an outstanding merit of the hollow polymer latex is that a layer containing the hollow polymer latex has excellent stripping property so that such a layer used in a diffusion transfer process and the like serves not only as a light-reflective layer, but also as a stripping layer. Great effects due to this advantage are obtained particularly when the hollow polymer latex layer is applied to monosheet type photographic elements which comprise one support having provided thereon an image-receiving layer, a background layer and a silver halide light-sensitive emulsion layer, and which are subjected to a diffusion transfer process or to heat-development. In more detail, a development-processed monosheet product (print) usually is a problem to file on a mount, because of its thickness. The method proposed for overcoming this problem as disclosed, e.g., in Japanese Patent Application (OPI) No. 67840/81 comprises separating an image-receiving element inclusive of a background layer from a light-sensitive element after development processing, to thereby make the print thinner. Nevertheless, all of commercially available light-sensitive materials of this type encounter the disadvantage of retarded movement of image-forming materials into an image-receiving layer, since an extra layer comprising a hydrophilic polymer must be provided as a stripping layer.

U.S. Pat. No. 4,459,346 describes the use, as a stripping layer, of a hydrophobic compound, such as a straight chain alkyl perfluoroalkylate sulfonamide ester or a polyethylene oxide perfluoroalkylate sulfonamide ester, in place of the aforesaid hydrophilic polymer. However, since this method similarly requires formation of an extra layer, there arise many disadvantages, such as an increase of cost and/or necessity of additional equipment for forming such a layer. Use of the light-reflective organic polymer layer in accordance with the present invention eliminates all of these disadvantages associated with the conventional photographic elements.

In cases where the light-reflective organic polymer layer of the present invention is applied to monosheet type diffusion transfer photographic light-sensitive materials having a higher performance, i.e., improved background whiteness, it is preferable to divide a white reflective layer into two or more layers. More specifically, a preferred embodiment of this invention is a monosheet type photographic light-sensitive material comprising a support having provided thereon at least an image-receiving layer, a white reflective layer, and a silver halide photographic emulsion layer, in the order listed, in which said white reflective layer is composed of at least two layers, one layer of which contains a larger amount of a light-reflective organic polymer than the other layer(s), and the other layer(s) of said white reflective layers contain(s) a larger amount of a light-reflective pigment than said layer containing a larger amount of a light-reflective organic polymer.

The above-described preferred embodiment is characterized in that the white reflective layer is composed of a plurality of layers. It is also characterized in that these layers comprise a light-reflective organic polymer in addition to the conventionally known light-reflective white pigment, e.g., titanium dioxide, zirconium oxide, alumina, barium sulfate, zinc oxide, etc.

The light-reflective pigment and the light-reflective organic polymer may be present in each of the plural white reflective layers, but it is preferred that at least one of them contains the light-reflective organic polymer at a weight ratio of at least about 5 with respect to the light-reflective pigment, if any. More preferably, at least one of the plural white reflective layers contains no light-reflective pigment at all. The other white reflective layer(s) preferably contain(s) the light-reflective organic polymer at a weight ratio of not greater than about 1/5 with respect to the light-reflective pigment. More preferably, the other layers contain(s) no light-reflective organic polymer.

It was confirmed that provision of a plurality of white reflective layers having varying contents of the light-reflective organic polymer brings about a surprising effect, that is, a markedly improved stripping property can be obtained as compared to the case of providing a single light-reflective layer.

The amount of the light-reflective polymer to be added can be appropriately selected depending on the intended end use. For example, when the light-reflective polymer is used in a white reflective layer, it is preferably used in such an amount as to result in a reflectance of 60% or more, and more preferably 75% or more. In the case when it is used in a layer adjacent to an emulsion layer, preferably a layer adjacent to the back side of an emulsion layer that is the farthest from the side to be exposed to light, for the purpose of increasing sensitivity, it is used in such a low amount so as to result in a reflectance of from 5 to 40%. In the case when the light-reflective polymer is used in a stripping layer for the purpose of facilitating separation of a light-sensitive element from an image-receiving element after development processing, it is added in an amount of from about 0.05 to about 2 g/m$^2$. If the stripping layer is intended to also function as a background layer, the amount of the light-reflective organic polymer is suitably up to about 30 g/m$^2$.

When the light-reflective organic polymer is used in a plurality of white reflective layers, it is added in a total amount of from about 0.2 to about 20 g/m$^2$, and more preferably from 0.5 to 10 g/m$^2$.

The layer comprising the light-reflective organic polymer which can be used in the present invention is preferably prepared from the polymer and a binder, but, if desired, various additional compounds may also be added. For example, in the case where the layer is utilized as a background layer, titanium dioxide may be added to a light-reflective polymer latex, depending on the particular purpose, in such an amount that does not adversely affect photographic properties. It is also possible to add known fluorescent brightening agents or blue dyes for the purpose of altering color tone.

The layer comprising the light-reflective polymer according to the present invention can be applied not only to photographic light-sensitive materials or image-receiving materials for silver salt or dye diffusion transfer process or heat development process, but also to general silver halide color photographic materials including color negative films, color papers, color positive films, color reversal films for slides, color reversal films for motion pictures, color reversal films for TV, etc.; and black-and-white photographic light-sensitive materials, such as black-and-white films, black-and-white papers, lith films, X-ray films, etc.

In applying the present invention to light-sensitive materials having two or more light-sensitive layers, a layer comprising the light-reflective polymer of the present invention can be provided between two light-sensitive layers in order to improve sensitivity of the upper layer, i.e., the one nearer to the side to be exposed to light. In color light-sensitive materials, it is particularly preferable that the two light-sensitive layers have substantially the same color sensitivity. Moreover, when the color light-sensitive material contains two or more pairs of light-sensitive layers, each pair having substantially the same color sensitivity, it is sufficient for one layer comprising the light-reflective polymer of the present invention to be present between one pair of light-sensitive layers, but the light-reflective polymer layer may also be present between every pair of light-sensitive layers.

In light-sensitive photographic papers, it is possible to improve saturation or contrast of an image by providing the light-reflective polymer layer between a light-sensitive layer and a support.

In transfer diffusion or heat-developable light-sensitive materials in which the layer comprising the light-reflective polymer is used as a stripping layer, it is preferable to apply the light-sensitive polymer layer of this invention to a background layer, but other dye image-donative substance-containing layers may also contain the light-reflective polymer. In the latter case, not only the light-reflective polymer-containing layer can serve as a stripping layer, but also working stability of a silver halide emulsion layer can be ensured.

Other materials to be used in the light-sensitive materials to which the present invention is applied are described below.

A light-sensitive silver halide emulsion which can be used in the present invention is a hydrophilic colloidal dispersion of silver chloride, silver bromide, silver chlorobromide, silver iodobromide, silver chloroiodobromide, or a mixture thereof. The halogen composition of the emulsion can be appropriately selected depending on the end use intended and processing conditions of the light-sensitive material, but preferably has an iodide content of not more than 10 mol%. Silver halide grains may be any of regular grains, plate-like grains, and twin grains, such as multiple twins (either parallel or non-parallel). These silver halide emulsions can be prepared by commonly employed processes, as described, e.g., in P. Glafkides, *Chimie Photographique,* 2nd ed., Chapters 18 to 23, Paul Montel (Paris) (1957).

The silver halide emulsion to be used in the present invention is desirably chemically sensitized with a natural sensitizer contained in gelatin; a sulfur sensitizer, e.g., sodium thiosulfate, N,N,N'-triethylthiourea, etc.; a gold sensitizer, e.g., a monovalent gold-thiocyanate complex salt or thiosulfate complex salt, etc.; or a reducing sensitizer, e.g., stannous chloride, hexamethylenetetramine, etc.; in combination with heat treatment.

In the present invention, either a negative emulsion which predominantly forms a latent image on the surface of grains or a so-called direct reversal silver halide emulsion that is developed in non-exposed areas (e.g., inner latent image type emulsion, or solarizaton type emulsion) can be used. Useful solarization type emulsions are described in James, Ed., *The Theory of the Photographic Process*, pp. 182–193, McMillan Co. (New York) (1977). Processes for preparing the solarization type emulsions are described, e.g., in British Pat. Nos. 443,245 and 462,730, U.S. Pat. Nos. 2,005,837, 2,541,472, 3,367,778, 3,501,305, 3,501,306, and 3,501,307, etc. Details of the inner latent image type direct positive emulsions are described, e.g., in U.S. Pat. Nos. 2,497,875, 2,588,982, 2,456,953, 3,761,276, 3,206,313, 3,317,322, 3,761,266, 3,850,637, 3,923,513, 3,736,140, 3,761,257, and 3,854,949. The direct reversal photographic emulsions are subjected to development processing in the presence of a nucleating agent after light exposure or uniformly exposed to light (at a high illumination for a short time, i.e., less than $10^{-2}$ second, or at a low illumination for a long time) in order to fog during surface development processing after light exposure, to thereby directly obtain a positive image. Use of a nucleating agent is preferred in view of easy control of fogging. The nucleating agent may be added either to the light-sensitive material or to a development solution, with the former being preferred. Typical examples of the nucleating agent useful for this type of emulsion are the hydrazines disclosed in U.S. Pat. Nos. 2,588,982 and 2,568,785; the hydrazides and hydrazones described in U.S. Pat. Nos. 3,227,552; the quaternary salt compounds described in British Pat. No. 1,283,835, Japanese Patent Publication No. 38164/74 and U.S. Pat. Nos. 3,734,738, 3,719,494, 3,615,615, 4,115,122; and the acylhydrazinophenylthiourea compounds described in German Patent Publication (OLS) No. 2,635,316.

The amount of the nucleating agent to be used can widely be varied according to the desired result. The concentration of the nucleating agent, when added to a light-sensitive material, generally ranges from 0.1 to 1,500 mg, and preferably from 0.5 to 700 mg, per mole of silver, though varying depending on the kind of the nucleating agent to be used.

When added to a developing solution, the aforesaid concentration is generally from about 0.05 to 5 g, and preferably from 0.1 to 1 g, per liter of the developing solution. When a nucleating agent is incorporated into any layer of a light-sensitive material, it is desirable that the nucleating agent be made fast to diffusion. The nucleating agent can be made fast to diffusion by bonding a ballast group commonly employed in photographic couplers to the nucleating agent.

The silver halide emulsions to be used in the present invention can be stabilized with commonly employed stabilizers. Furthermore, the silver halide emulsions may contain a sensitizing compound, such as a polyethylene oxide compound.

The silver halide emulsions to be used in the present invention may be spectrally sensitized, if desired. Useful spectral sensitizers include cyanines, merocyaninies, holopolar cyanines, styryls, hemicyanines, oxonols, hemioxonols, and the like. Specific examples of the spectral sensitizers are described in P. Glafkides, *Chimie Photographique*, 2nd ed., Chapters 35 to 41, Paul Montel (1957) and F. M. Hamer, *The Cyanine and Related Compounds*, Interscience. In particular, cyanine dyes having a nitrogen atom of their basic heterocyclic nucleus substituted with an aliphatic group (e.g., an alkyl group) having a hydroxyl group, carboxyl group or a sulfo group, such as those described in U.S. Pat. Nos. 2,503,776, 3,459,553, and 3,177,210, are useful in carrying out the present invention.

When the present invention is applied to color light-sensitive materials, dye image-providing substances to be used therein are either negative or positive as is well known in the art, and either mobile or immobile in an alkaline aqueous solution. The most representative dye image-providing substances are color couplers used in conventional color light-sensitive materials.

Negative dye image-providing substances useful for color diffusion transfer or heat-developable light-sensitive materials include couplers capable of forming or releasing a dye upon reacting with an oxidation product of a color developing agent. Specific examples of such couplers are described in U.S. Pat. No. 3,227,550 and Canadian Pat. No. 602,607. The particularly preferred are dye-releasing redox compounds (DRR compounds) capable of releasing a dye upon reacting with a developing agent in an oxidized state or an electron transfer agent. Specific examples of such redox compounds are described, e.g., in Japanese Patent Application (OPI) Nos. 33826/73, 54021/79, 113624/76, and 71072/81.

The immobile positive dye image-providing substances which can be used in the present invention include compounds capable of releasing a diffusible dye without accepting an electron (i.e., without being reduced) or after accepting at least one electron (i.e., after being reduced) during photographic processing.

Further, the positive dye image-providing substances that are mobile in an alkaline solution include dye developing agents. Typical examples thereof are described, e.g., in Japanese Patent Publication No. 32130/73 and 22780/80.

Dyes formed from the dye image-providing substances according to the present invention may be either complete dyes or dye precursors that can be converted into dyes during photographic processing or follow-up processing. The finally-obtained dye image may or may not be metallized. Typical dye structures useful for color diffusion transfer or heat-developable light-sensitive materials include metallized or non-metallized azo dyes, axomethine dyes, anthraquinone dyes or phthalocyanine dyes. Among them, cyan, magneta and yellow dyes of azo type are particularly important.

Specific examples of yellow dye image-providing substances which can be used in the present invention are described in Japanese Patent Publication No. 2618/74, U.S. Pat. No. 3,309,199, Japanese Patent Publication No. 12140/82, Japanese Patent Application (OPI) Nos. 114930/76, 111344/79, 16130/81, 71072/81, 79031/79, 64036/78, and 23527/79, U.S. Pat. Nos. 4,148,641 and 4,148,643, *Research Disclosure*, RD No. 17630 (December, 1978) and ibid. RD No. 16475 (December, 1977).

Specific examples of magneta dye image-providing substances which can be used in the present invention are described in U.S. Pat. No. 3,453,107, Japenese Patent Publication No. 43950/71, Japenese Patent Application (OPI) No. 106727/77, U.S. Pat. Nos. 3,932,380, 3,931,144, and 3,932,308, Japanese Patent Application (OPI) Nos. 115528/75, 106727/77, 23628/78, 65034/79, 36804/80, 161332/79, 4028/80, 73057/81, 71060/81, 134/80, and 35533/78, U.S. Pat. Nos. 4,207,104 and 4,287,292, etc.

Specific examples of cyan dye image-providing substances which can be used in this invention are described in Japanese Patent Publication No. 32130/73, Japanese Patent Application (OPI) Nos. 8827/77, 126331/74, 109928/76, 99431/79, 149328/78, 8827/77, 47823/78, 143323/78, 99431/79, 71061/81, 64035/78, and 121125/79, U.S. Pat. Nos. 4,142,891, 4,195,994, 4,147,544, and 4,148,642, European Pat. Nos. 53,037 and 53,040, *Research Disclosure,* RD No. 17630 (December, 1978), ibid. RD No. 16475 (December, 1977), etc.

As a type of dye precursors, DRR compounds having a dye moiety in which light absorption is temporarily shifted within a light-sensitive element can also be employed in the present invention. Specific examples of such compounds are shown in Japanese Patent Application (OPI) Nos. 53330/80 and 53329/80, U.S. Pat. Nos. 3,336,287, 3,579,334, and 3,982,946 and British Pat. No. 1,467,317.

In using a DRR compound in the present invention, any silver halide developing agent can be used, as long as it is capable of cross-oxidizing the DRR compound. Such a developing agent may be incorporated in either an alkaline processing solution (processing element) or an appropriate layer of the photographic element as mentioned before. Examples of developing agents which can be used in the present invention are hydroquinone and aminophenols, e.g., N-methylaminophenol, 1-phenyl-3-pyrazolidinone, 1-phenyl-4,4-dimethyl-3-pyrazolidinone, 1-phenyl-4-methyl-4-oxymethyl-3-pyrazolidinone, N,N-diethyl-p-phenylenediamine, 3-methyl-N,N-diethyl-p-phenylenediamine, 3-methoxy-N-ethoxy-p-phenylenediamine, etc.

Of these developing agents, black-and-white developing agents having a property to reduce stain formation in an image-receiving layer (mordant layer) are generally preferred.

In carrying out the present invention by using a DRR compound, a conventional emulsion that undergoes development according to exposure forms a negative transferred image and a positive residual image. On the other hand, if the silver halide emulsion used is the above-described direct reversal silver halide emulsion that is developed in unexposed areas, a positive image is formed on an image-receiving material or layer.

A transferred positive image may also be obtained by a DIR reversal emulsion process as disclosed in U.S. Pat. Nos. 3,227,551, 3,227,554, and 3,364,022, or a reversal emulsion process making use of solution physical development as disclosed in British Pat. No. 904,364. A series of processes for obtaining color diffusion transfer images is described, e.g., in U.S. Pat. Nos. 3,227,550 and 3,227,552 and British Pat. No. 1,330,524.

Color developing agents to be used for diffusible dye-releasing couplers typically include p-phenylenediamine derivatives as described in U.S. Pat. Nos. 3,227,552, 2,559,643, and 3,813,244 and p-aminophenol derivatives as described in Japanese Patent Application (OPI) No. 26134/73. These color developing agents are incorporated in an alkaline developing solution preferably placed in a destroyable container. The color developing agents may also be incorporated in an independent layer or a silver halide emulsion layer within a light-sensitive material.

Supports which can be used in the present invention preferably do not undergo remarkable dimensional changes during processing. Such supports include those employed in general photographic light-sensitive materials, such as a cellulose acetate film, a polystyrene film, a polyethylene terephthalate film, a polycarbonate film, etc. In addition, paper or paper laminated with a water impermeable polymer, e.g., polyethylene, can also effectively be used as supports.

Details for a silver salt diffusion transfer process are described in Neblette, *Photography, its Materials and Processes,* 6th ed., pp. 368–391; John M. Sturge (ed.), *Neblette's Hanbood of Photography and Reprography, Materials, Processes and System,* 7th ed., pp. 247–255.

A neutralizing layer which can be used in a diffusion transfer process preferably comprises any of film-forming acidic polymers. Examples of such acidic polymers are a maleic anhydride-ethylene copolymer monobutyl ester, a maleic anhydride-methyl vinyl ether monobutyl ester, a maleic anhydrideethylene monoethyl ester, monopropyl ester, monobenzyl ester or monohexyl ester, polyacrylic acid, polymethacrylic acid, acrylic acidmethacrylic acid copolymers having various comonomer ratios, and copolymers of acrylic acid or methacrylic acid and other vinyl monomers, e.g., acrylic esters, methacrylic esters, vinyl ethers, acrylamide, methacrylamide, etc., at various comonomer ratios, preferably having an acrylic acid or methacrylic acid content of from 50 to 90 mol%. Reference can be made to a neutralizing layer, e.g., in U.S. Pat. Nos. 3,362,819, 3,765,885, and 3,819,371 and French Pat. No. 2,290,699. Of these, polyacrylic acid and an acrylic acid-butyl acrylate copolymer are preferred.

A neutralization timing layer mainly comprises, for example, gelatin, polyvinyl alcohol, polyacrylamide, a partially hydrolyzed polyvinyl acetate, a $\beta$-hydroxyethyl methacrylate-ethyl acrylate copolymer, or acetyl cellulose. Other examples of materials for the neutralization timing layer are described in U.S. Pat. Nos. 3,445,686, 3,421,893, 3,785,815, 3,847,615, and 4,009,030, Japanese Patent Application (OPI) No. 14415/77, etc. A polymer layer having greatly temperature-dependent permeability to an alkaline processing solution as disclosed in U.S. Pat. Nos. 4,056,394 and 4,061,496 and Japanese Patent Application (OPI) Nos. 72622/78 and 78130/79 may be provided in combination with the abovedescribed neutralization timing layer.

The light-sensitive material to which the present invention can be applied may have a light-shielding layer in order to enable development processing in light. The light-shielding layer can be formed by coating a black pigment, e.g., carbon black, using a water-soluble polymer, e.g., gelatin, as a binder.

An image-receiving layer to be used in color diffusion transfer development or heat development preferably contains a polymer mordant. Preferred polymer mordants are polymers having a secondary or tertiary amino group, a nitrogen-containing heterocyclic group or a quaternary cation group of these groups and having a molecular weight more than 5,000, and more preferably more than 10,000.

Specific examples of these polymer mordants include vinylpyridine polymers and vinylpyridinium cation polymers as disclosed in U.S. Pat. Nos. 2,548,564, 2,484,430, 3,148,061, and 3,756,814; vinylimidazolium cation polymers as disclosed in U.S. Pat. No. 4,124,386; polymer mordants crosslinkable with gelatin, etc., as disclosed in U.S. Pat. Nos. 3,625,694, 3,859,096, and 4,128,538 and British Pat. No. 1,277,453; aqueous sol type mordants as disclosed in U.S. Pat. Nos. 3,958,995, 2,721,852, and 2,798,063 and Japanese Patent Application (OPI) Nos. 115228/79, 145529/79, 126027/79, 155835/79, and 17352/81; water-insoluble mordants as disclosed in U.S. Pat. No. 3,898,088; reactive mordants capable of covalently bonding with a dye as disclosed in U.S. Pat. Nos. 4,168,976 and 4,201,840; and other mordants as disclosed in U.S. Pat. Nos. 3,709,690, 3,788,855, 3,642,482, 3,488,706, 3,557,066, 3,271,147, and 3,271,148, Japanese Patent Application (OPI) Nos. 30328/78, 155528/77, 125/78, 1024/78, and 107835/78, British Pat. No. 2,064,802, etc.

In addition, the mordants described in U.S. Pat. Nos. 2,675,316 and 2,882,156 may also be used.

Details for other materials and layer structures used in heat developable light-sensitive materials and image-receiving materials are described, e.g., in European Pat. No. 76492A2.

Certain preferred embodiments of the present invention are hereinafter summarized, but the present invention is not limited thereto.

1. A photographic element according to claim 1, wherein the element is a color diffusion transfer photographic element.

2. A color diffusion transfer photographic element according to Embodiment 1, wherein the element is a monosheet type element.

3. A photographic element according to claim 1, wherein the layer comprising a light-reflective polymer is formed by coating a hollow latex polymer containing air in the interior of the polymer particles.

4. A photographic element according to claim 1, wherein said element is a monosheet type color diffusion transfer photographic element having a light-reflective layer containing a hollow latex polymer.

5. A photographic element according to Embodiment 4, wherein said light-reflective layer is a background layer containing a hollow latex polymer.

6. A photographic element according to Embodiment 4, wherein said hollow latex polymer is incorporated in a layer adjacent to the silver halide emulsion layer on the side of the support opposite to the surface to be exposed to light.

7. A photographic element according to Embodiment 4, wherein said element comprises a support having provided thereon at least an image-receiving layer, at least two white reflective layers and a silver halide emulsion layer, at least one of said white reflective layers having a larger content of a light-reflective organic polymer than the other layer(s), and the other layer(s) of said white reflective layers contain(s) a larger amount of a light-reflective pigment than said layer having a larger amount of a light-reflective organic polymer.

The present invention will now be illustrated in greater detail with reference to the following examples, but it should be understood that the present invention is not limited thereto. In these examples, all of the percent values are by weight unless otherwise indicated.

EXAMPLE 1

Use of Hollow Polymer Latex in Background Layer

Two hundred and fifty grams of OP-42 (trademark for a hollow polymer latex produced by Rohm & Haas Co.; solids content: 40 wt%) and 100 g of gelatin were mixed by stirring at 100 rpm (Sample A).

For comparison, 1 g of carboxymethyl cellulose and 100 ml of water were added to 100 g of R-180 (trademark for titanium dioxide produced by Ishihara Sangyo Kaisha, Ltd.) to make a thoroughly wet state, and the mixtures were dispersed in a Polytron TP 10/35 Model dispersion mixer (produced by Kanematica Co.) at 5,000 rpm for 30 minutes. The dispersion was then mixed with 100 g of a 10% aqueous gelatin solution in the same dispersion mixer as used above at 100 rpm (Comparative Sample $B_1$) or 3,000 rpm (Comparative Sample $B_2$). The state upon mixing was as follows.

TABLE 1

| Sample | State of Mixing |
|---|---|
| A | The components were uniformly mixed to form a stable dispersion. |
| $B_1$ | Flocculation occurred at the time of mixing. Upon allowing the mixture to stand for 3 days, a clear supernatant liquor was formed. |
| $B_2$ | Slight flocculation occurred during mixing, but the mixture was again dispersed by the dispersing effect of the Polytron mixer to provide a stable dispersion. |

Each of Samples A and $B_2$ was coated on a 100 μm thick polyester base to an OP-42 or $TiO_2$ coverage of 20 g/m$^2$. Sample $B_1$ could not be coated because of the flocculation. Black paper was attached onto each coated layer, and a spectral reflectance at the polyester base side on a black background was determined. The results obtained are shown in Table 2 below.

TABLE 2

| Sample | Spectral Reflectance (440 nm) |
|---|---|
| A | 85% |
| $B_2$ | 83% |

It is apparent from Table 1 that the compound of the present invention has an extremely excellent compatibility with gelatin and even if a shear force is not applied (i.e., an energy is not applied), the compound can be sufficiently used. Further, it is apparent from Table 2 that the compound of the present invention has a reflectance as the background layer equal to that of titanium oxide. In summary, it is apparent from Tables 1 and 2 that the compund of the present invention a material which can improve process steps as compared to titanium oxide and provide the reflectance equal to that of titanium oxide.

Use of Hollow Polymer Latex as Background Layer in Photographic System

In order to evaluate effects of the present invention in an actual photographic system, the following light-sensitive sheet, cover sheet and processing solution were prepared.

Light-Sensitive Sheet

Onto a polyethylene terephthalate transparent support were coated the following layers (1) to (12), in the order listed, to prepare a light-sensitive sheet.

(1) An image-receiving layer containing 3 g/m$^2$ of a polymer of the formula

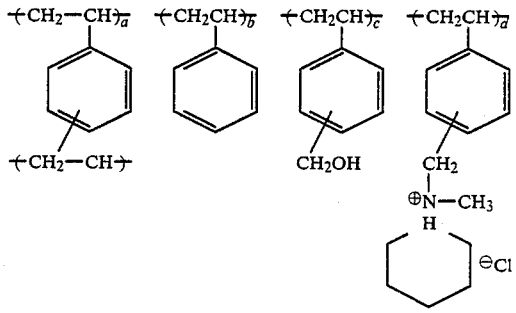

wherein a/b/c/d=5/47.5/5.5/42, 3 g/m² of gelatin, and 3 mg/m² of a coating aid of the formula

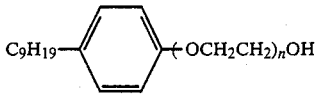

wherein n=ca. 30.

(2) A background layer containing 20 g/m² of a whitening agent (titanium oxide) and 2.0 g/m² of gelatin (prepared by coating Sample A or Sample $B_2$ of Example 1).

(3) A light-shielding layer containing 1.5 g/m² (on a solid basis) of carbon black and 0.75 g/m² of gelatin.

(4) A layer containing 0.44 g/m² of a cyan dye-releasing redox compound of the formula

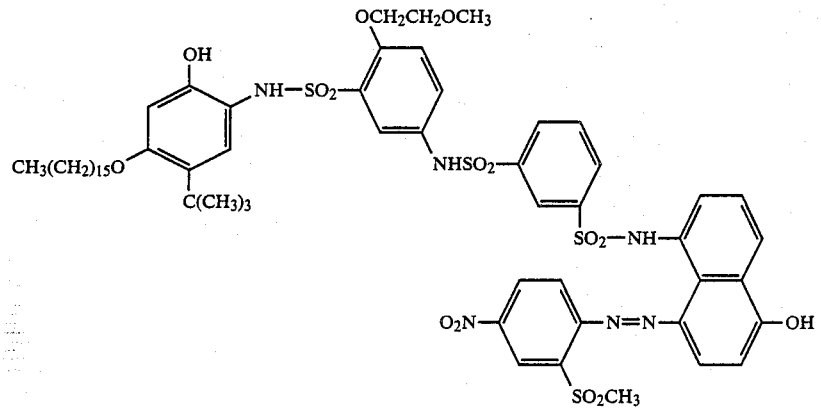

and 0.09 g/m² of tricyclohexyl phosphate, 0.008 g/m² of 2,5-di-t-pentadecylhydroquinone, and 0.8 g/m² of gelatin.

(5) A red-sensitive emulsion layer containing 1.03 g of silver per m² of a red-sensitive internal latent image type direct positive silver bromide emulsion, 1.2 g/m² of gelatin, 0.04 mg/m² of a nucleating agent of the formula

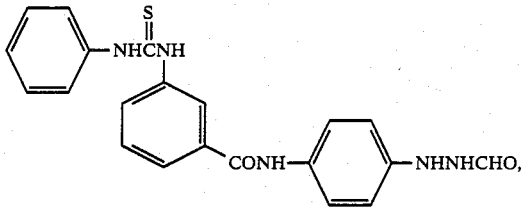

and 0.13 g/m² of sodium 2-sulfo-5-n-pentadecylhydroquinone.

(6) A layer containing 0.43 g/m² of 2,5-di-t-pentadecylhydroquinone, 0.1 g/m² of trihexyl phosphate, and 0.4 g/m² of gelatin.

(7) A layer containing 0.21 g/m² of a magenta dye-releasing redox compound of formula (I), 0.11 g/m² of a magenta dye-releasing redox compound of formula (II), 0.08 g/m² of tricyclohexyl phosphate, 0.009 g/m² of 2,5-di-t-pentadecylhydroquinone and 0.9 g/m² of gelatin (I)

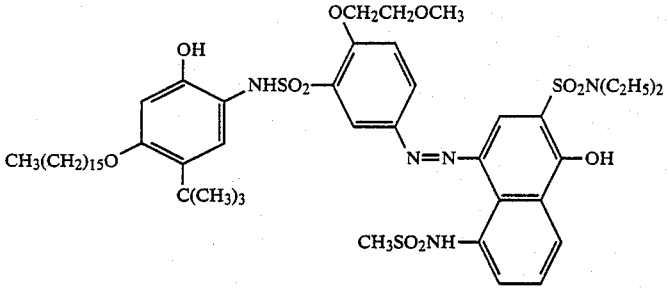

(II)

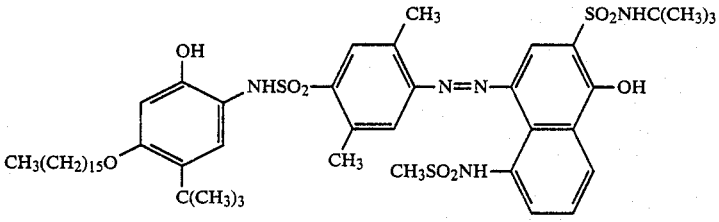

(8) A green-sensitive emulsion layer containing 0.82 g-Ag/m² of a green-sensitive inner latent image type direct positive silver bromide emulsion, 0.9 g/m² of gelatin, 0.03 mg/m² of the same nucleating agent as used in Layer (5), and 0.08 g/m² of sodium 2-sulfo-5-n-pentadecylhydroquinone.

(9) The same layer as Layer (6).

(10) A layer containing 0.53 g/m² of a yellow dye-releasing redox compound of the formula

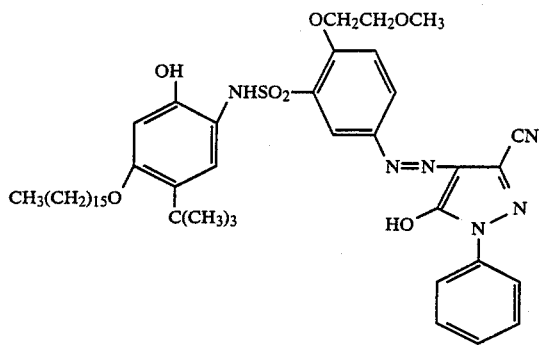

0.13 g/m² of tricyclohexyl phosphate, and 0.014 g/m² of 2,5-di-t-pentadecylhydroquinone and 0.7 g/m² of gelatin.

(11) A blue-sensitive emulsion layer containing 1.09 g-Ag/m² of a blue-sensitive inner latent image type direct positive silver bromide emulsion, 1.1 g/m² of gelatin, 0.04 mg/m² of the same nucleating agent as used in Layer (5), and 0.07 g/m² of sodium 2-sulfo-5-n-pentadecylhydroquinone.

(12) A layer containing 1.0 g/m² of gelatin.

The light-sensitive sheet using Sample A in the background layer is designated as Light-Sensitive Material A and that using Sample $B_2$ is designated as Light-Sensitive Material $B_2$.

Cover Sheet

Onto a polyethylene terephthalate support were coated the following layers, in the order listed, to prepare a cover sheet.

(1) A neutralizing layer containing 22 g/m² of an acrylic acid-butyl acrylate copolymer (8/2 by mole) having an average molecular weight of 50,000.

(2) A neutralization timing layer containing cellulose acetate having an acetyl value of 51.3% (this means that 0.513 g of acetic acid is released from 1 g of a cellulose acetate sample by hydrolysis) and a styrene-maleic anhydride copolymer (1/1 by mole) having an average molecular weight of about 10,000 at a weight ratio of 95/5 in a total amount of 4.5 g/m².

(3) A layer containing 1.6 g/m² (on a solid basis) of a polymer blend comprising (a) a polymer latex obtained by emulsion polymerization of styrene, butyl acrylate, acrylic acid, N-methylolacrylamide at a weight ratio of 49.7/42.3/4/4 and (b) a polymer latex obtained by emulsion polymerization of methyl methacrylate, acrylic acid, N-methylolacrylamide at a weight ratio of 93/3/4 at a blending ratio (a)/(b) of 6/4 on a solid basis.

(4) A layer containing 4 g/m² of gelatin.

Each of Light-Sensitive Sheets A and $B_2$ was exposed to light through a color test chart, and the above-described cover sheet was superposed thereon. A processing solution having the following formulation was spread between the light-sensitive sheet and the cover sheet with an aid of a pressure roll so as to have a thickness of 85 μm.

| Formulation of Processing Solution: | |
|---|---|
| 1-p-Tolyl-4-hydroxymethyl-4-methyl-3-pyrazolidone | 6.9 g |
| Methylhydroquinone | 0.3 g |
| 5-Methylbenzotriazole | 3.5 g |
| Anhydrous sodium sulfite | 0.2 g |
| Sodium carboxymethyl cellulose | 58 g |
| Potassium hydroxide (28% aqueous solution) | 200 ml |
| Benzyl alcohol | 1.5 ml |
| Carbon black | 150 g |
| Water | 685 ml |

The processing was carried out at 25° C. At 60 minutes after the processing, photographic characteristics (maximum and minimum red reflection densities) of the color positive image obtained on each sheet were determined. The results obtained are shown in Table 3 below.

TABLE 3

| Light-Sensitive Material | $D^R$ max | $D^R$ min |
|---|---|---|
| A | 2.25 | 0.36 |
| $B_2$ | 2.23 | 0.36 |

It can be seen from Table 3 that Light-Sensitive Material A according to the present invention provides sufficient whiteness of the background without adversely affecting photographic properties.

A cut was made in a part of the support of each light-sensitive materials with a cutter, and the image-receiving element including the background layer was stripped from the cut. The percent of area which could be neatly stripped on one plane was obtained. As a result, Light-Sensitive Material A was completely separated at the interface between the background layer and the light-shielding layer (percent of stripped area: 98%) so that the resulting color print could be very thin. Whereas, Light-Sensitive Material $B_2$ was separated at the interface wherein the processing solution was present and was, therefore, apt to get contaminated. In addition, the reverse side of the color print (i.e., stripped surface) of Light-Sensitive Material A was white, and, therefore, convenient for writing upon with a pencil, etc.

EXAMPLE 3

Use of Hollow Polymer Latex as White Reflective Layer in Photographic System

Preparation of Dispersion for White Reflective Layer (1) Light-Reflective Polymer Dispersion (1)

A mixture of 250 g of OP-42 and 30 g of a 10% gelatin aqueous solution was stirred using stirring wings at 100 rpm for 5 minutes.

(2) Titanium Dioxide Dispersion (2)

To 100 g of R-780 were added 1 g of carboxymethyl cellulose and 100 ml of water to provide a thoroughly wet state, and the mixture was dispersed in a Polytron PT 10/35 Model dispersing mixer at 5,000 rpm for 30 minutes. Fifty grams of a 10% gelatin aqueous solution were added thereto, and stirring was continued for an additional 30 minutes at 3,000 rpm.

Preparation of Light-Sensitive Sheet

Onto a transparent polyethylene terephthalate support that had been subjected to subbing treatment were coated the following layers in the order listed to prepare a light-sensitive material.

(1) A mordant layer containing 3.0 g/m$^2$ of copoly[styrene-N-vinylbenzyl-N,N,N-trihexylammonium chloride] and 3.0 g/m$^2$ of gelatin.

(2) A white reflective layer A obtained by coating the above-described dispersion (2) or a mixture of the dispersions (2) and (1) so as to contain titanium oxide, OP-42 and gelatin in amounts shown in Table 4.

(3) A white reflective layer B obtained in the same manner as for white reflective layer A.

(4) A light-shielding layer containing 3.0 g/m$^2$ of carbon black and 2.0 g/m$^2$ of gelatin.

(5) to (13) The same as Layers (4) to (12) as used in Example 2.

Each of the resulting light-sensitive sheets (Sample Nos. 1 to 9) was exposed to light and developed in the same manner as described in Example 2. The photographic properties (maximum and minimum red reflection density) of the resulting color positive image are shown in Table 3.

Further, a cut was made in a part of the support of the light-sensitive sheet at 1 hour and at 7 days after the processing, and the material was separated apart from the cut at the interface between the white reflective layer B and the light-shielding layer. The percent of the stiripped area is shown in Table 5.

Furthermore, several scratches were made on the coated surface of the light-sensitive sheet before processing. An adhesive tape was adhered thereon, and the light-sensitive sheet and the adhesive tape were peeled apart to evaluate the stripping property. The percent of the stripped area is also shown in Table 5.

with a small force either before or after development processing to provide a thin print having a smooth, uniform and neat reverse side (i.e., stripped surface).

EXAMPLE 4

Each of Light-Sensitive Material Sample Nos. 1 and 9 prepared in Example 3 was assembled into a commercially available film unit (FI-10 Film Unit of Fuji Photo Film Co., Ltd.) together with the same cover sheet as used in Example 3, the same processing solution as used in Example 3, a masking material, a processing solution pod, a trapping material, and a railing material. Perforated line was made on the border of the support as described in Japanese Patent Application (OPI) No. 67840/81. The film unit prepared from Light-Sensitive Material 1 was designated as Unit A, and that from Light-Sensitive Material 9 was designated as Unit B.

The film unit was exposed to light through a color test chart from the side of the cover sheet, and the developing solution was spread at 25° C. with an aid of a pressure roll. Thirty minutes later, the transferred dye density reached saturation. After measuring the density, the print was stripped along the perforation.

In Unit A, a strong force was required for stripping. If the material was stripped by force, some part of the material was stripped at the interface between the processing solution and the cover sheet or within the layers of the cover sheet, and the processing solution became non-uniform and sticky to the touch. To make a contrast, in Unit B, both the image area and the border area were uniformly stripped with a very weak force to provide a thin photographic print, the reverse side of which (stripped surface) was as white and beautiful as in the case of general color paper.

When the resulting print was adhered to a white mount of an album, the background of the image of Unit B was extremely white as compared with that of Unit

TABLE 4

| Sample No. | Coverage on White Reflective Layer (g/m$^2$) Reflective Layer A $TiO_2$ | OP-42 | Gelatin | Reflective Layer B $TiO_2$ | OP-42 | Gelatin | Total Coverage on White Reflective Layer (g/m$^2$) $TiO_2$ | OP-42 | Gelatin | Remark |
|---|---|---|---|---|---|---|---|---|---|---|
| 1 | 20 | 0 | 2 | — | — | — | 20 | 0 | 2 | Comparison |
| 2 | 20 | 10 | 2 | — | — | — | 20 | 10 | 2 | " |
| 3 | 13 | 2 | 2 | — | — | — | 13 | 2 | 2 | " |
| 4 | 13 | 10 | 2 | — | — | — | 13 | 10 | 2 | " |
| 5 | 13 | 0 | 1.3 | 0 | 2 | 0.7 | 13 | 2 | 2 | Invention |
| 6 | 13 | 0 | 1.3 | 0 | 6 | 0.7 | 13 | 6 | 2 | " |
| 7 | 13 | 0 | 1.3 | 0 | 10 | 0.7 | 13 | 10 | 2 | " |
| 8 | 13 | 4 | 1.3 | 0 | 4 | 0.4 | 13 | 8 | 1.7 | " |
| 9 | 13 | 0 | 1.3 | 0 | 2 | 0.2 | 13 | 2 | 1.5 | " |

TABLE 5

| Sample No. | Photographic Property $D_{min}^R$ | $D_{max}^R$ | Stripped Area (%) 1 Hour After Processing | 7 Days After Processing | Before Processing | Rate of Transfer T 50%* (sec) | Remark |
|---|---|---|---|---|---|---|---|
| 1 | 0.32 | 2.20 | ~0 | ~0 | ~0 | 65 | Comparison |
| 2 | 0.29 | 2.23 | 50 | 23 | 25 | 97 | " |
| 3 | 0.38 | 1.97 | 10 | ~5 | 5 | 59 | " |
| 4 | 0.32 | 2.21 | 80 | 60 | 87 | 78 | " |
| 5 | 0.32 | 2.19 | 75 | 53 | 51 | 63 | Invention |
| 6 | 0.30 | 2.20 | 93 | 85 | 95 | 67 | " |
| 7 | 0.29 | 2.30 | 100 | 98 | 100 | 71 | " |
| 8 | 0.30 | 2.18 | 94 | 90 | 100 | 63 | " |
| 9 | 0.32 | 2.22 | 100 | 98 | 100 | 57 | " |

Note:
*The rate of transfer is the time required for reaching 50% of the density which is achieved after 60-minute processing.

The results of Table 5 prove that the photographic elements having two white reflective layers, at least one of which containing a light-reflective polymer (OP-42), according to the present invention exhibit sufficient whiteness ($D_{min}$) and excellent stripping property without retarding the transfer of dyes. In particular, the elements of the present invention can be stripped apart A, and also the monochromatic area of Unit B was very bright and had a good image quality.

Further, the minimum density of the film on the mount was determined using a Macbeth reflection densitometer. The results obtained are shown in Table 6.

TABLE 6

| Film Unit | Light-Sensitive Sheet | Before Stripping | | | After Stripping | | |
|---|---|---|---|---|---|---|---|
| | | Blue | Green | Red | Blue | Green | Red |
| A | 1 | 0.19 | 0.20 | 0.32 | 0.20 | 0.21 | 0.33 |
| B | 9 | 0.19 | 0.20 | 0.32 | 0.17 | 0.17 | 0.26 |

As is apparent from Table 6, the light-sensitive element according to the present invention can provide a high quality color image having a surprisingly low minimum density.

While the invention has been described in detail and with reference to specific embodiments thereof, it will be apparent to one skilled in the art that various changes and modifications can be made therein without departing from the spirit and scope thereof.

What is claimed is:

1. A monosheet-type color diffusion transfer photographic element comprising a support having thereon the following layers in sequence:

an image-receiving layer;

a layer of a light-reflective organic polymer comprising a hollow latex polymer containing air in the interior of the polymer particles; and at least one of a light-sensitive silver halide emulsion layer wherein said light reflective layer is composed of at least two layers, and werein at least one layer of said light reflective layers contains a larger amount of a light-reflective organic polymer than the other layer(s), and the other layer(s) of said light reflective layers contain(s) a larger amount of a light-reflective pigment than said layer containing a larger amount of a light-reflective organic polymer.

2. A photographic element as in claim 1, wherein said layer containing a larger amount of a light-reflective organic polymer does not contain a light-reflective pigment.

3. A photographic element as in claim 1, wherein said layer containing a larger amont of a light-reflective pigment does not contain a light-reflective organic polymer.

* * * * *